US008823252B1

(12) United States Patent
Iacovoni et al.

(10) Patent No.: US 8,823,252 B1
(45) Date of Patent: Sep. 2, 2014

(54) INCANDESCENT LAMP HAVING BENT FILAMENT TERMINAL ENDS

(71) Applicant: Ford Global Technologies, LLC, Dearborn, MI (US)

(72) Inventors: Donald P. Iacovoni, Plymouth, MI (US); Frederick Masters, Ann Arbor, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 13/919,172

(22) Filed: Jun. 17, 2013

(51) Int. Cl.
*H01K 1/18* (2006.01)
*H01K 1/16* (2006.01)
*H01K 7/04* (2006.01)

(52) U.S. Cl.
CPC ... *H01K 7/04* (2013.01); *H01K 1/18* (2013.01)
USPC ..... 313/315; 313/271; 313/341; 313/578

(58) Field of Classification Search
CPC ..... H01K 1/18–1/24; H01K 1/42–1/48
See application file for complete search history.

(56) References Cited

U.S. PATENT DOCUMENTS 951,400 A 3/1910 Knight
1,975,499 A 10/1934 Braselton
2,007,926 A 7/1935 Braselton
3,600,053 A 8/1971 Smith
3,988,630 A * 10/1976 Anderson et al. ..... 313/271
4,812,710 A 3/1989 Klam et al.
6,137,225 A * 10/2000 Heuvelmans et al. ..... 313/580
6,384,530 B1 5/2002 Yu et al.
6,784,605 B2 8/2004 Sakai et al.
8,215,002 B2 7/2012 Tucker et al.
2007/0241654 A1 10/2007 Cassidy

FOREIGN PATENT DOCUMENTS

WO WO9960604 A1 * 11/1999

OTHER PUBLICATIONS

Iacovoni, Don and Masters, Rick, "Improved Life for Krypton-Filled Brake Bulbs," SAE International 05B-310, Copyright 2004, 6 pages.

* cited by examiner

*Primary Examiner* — Mariceli Santiago
(74) *Attorney, Agent, or Firm* — Raymond Coppiellie; Price Heneveld LLP

(57) ABSTRACT

An incandescent lamp is provided having first and second attach lead wires and a filament having a coil portion between first and second end portions. The first and second end portions are crimped to the first and second wires, respectively. The first end portion has a bent portion and the second end portion has a second bent portion to prevent migration of the coil portion relative to the first and second lead wires.

19 Claims, 2 Drawing Sheets

INCANDESCENT LAMP HAVING BENT FILAMENT TERMINAL ENDS

FIELD OF THE INVENTION

The present invention generally relates to lighting assemblies having a filament, and more particularly relates to an incandescent lamp having a filament attached to leads in a manner to prevent migration of the filament coil.

BACKGROUND OF THE INVENTION

Incandescent lamps are commonly used in automotive vehicles to provide lighting, such as for tail lamp and brake lamp applications. In vehicle applications, the incandescent lamp is often exposed to dynamic forces, such as road vibration imposed upon the vehicle. Conventional incandescent lamps typically have a filament coil extended between attach lead wires that supply electric current across the filament. The orientation of the filament can have an effect on its resistance to failure in a vibratory environment. The filament may move or migrate through the attach lead wires under vibratory conditions, particularly when mounted with a vertical filament orientation, thereby resulting in susceptibility to vibration related failures or shortened lamp life. As a result, the lamp may be damaged and may have to be replaced. It would be desirable to provide for a robust incandescent lamp that is less susceptible to vibration damage, regardless of the filament orientation.

SUMMARY OF THE INVENTION

According to one aspect of the present invention, an incandescent lamp is provided. The incandescent lamp includes a first lead wire, a second lead wire and a filament crimped to the first and second lead wires. The filament includes a first end having a first bent portion and a second end having a second bent portion for preventing movement of the filament relative to the first and second lead wires.

According to another aspect of the present invention, an incandescent lamp is provided that includes a first lead wire, a second lead wire, and a filament. The filament includes first and second ends and a coil portion therebetween. The first end has a first bent portion and is crimped to the first lead wire and the second end has a second bent portion and is crimped to the second lead wire. The first and second bent portions prevent migration of the coil portion relative to the first and second lead wires.

These and other aspects, objects, and features of the present invention will be understood and appreciated by those skilled in the art upon studying the following specification, claims, and appended drawings.

DETAILED DESCRIPTION OF THE PREFERRED EMBODIMENTS

As required, detailed embodiments of the present invention are disclosed herein;

however, it is to be understood that the disclosed embodiments are merely exemplary of the invention that may be embodied in various and alternative forms. The figures are not necessarily to a detailed design; some schematics may be exaggerated or minimized to show function overview. Therefore, specific structural and functional details disclosed herein are not to be interpreted as limiting, but merely as a representative basis for teaching one skilled in the art to variously employ the present invention.

Figure 1:
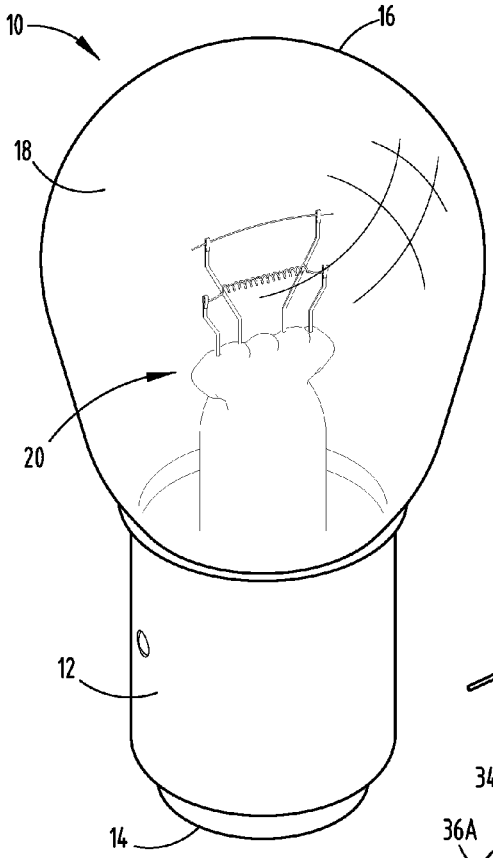
FIG. 1 is a perspective view of a dual-filament incandescent lamp having a filament with a coil portion and bent portions at the ends of the filament, according to one embodiment.

Referring to FIG. 1, an incandescent lamp 10 for generating light is generally shown according to one embodiment. Lamp 10 shown and described herein is a dual-filament lamp, according to one embodiment, and may be employed on an automotive vehicle, such as for use in a tail lamp assembly to provide both vehicle tail lamp and brake lamp functions. The incandescent lamp 10 may be oriented at various use positions. In one position, the longitudinal axis of the lamp 10 may be arranged substantially horizontal or parallel to the ground surface. It should be appreciated that the incandescent lamp 10 may have one or more lighting filaments and may be employed on any number of vehicles and may be employed in other lighting applications.

The incandescent lamp 10 includes a base 12 forming part of a housing and having one or more electrical contacts 14 provided at the contact end thereof to allow for electrical connection to an electrical power source, such as a vehicle battery. The vehicle battery may supply a DC voltage such as twelve (12) volts. The lamp 10 as shown may also be referred to as a lightbulb. Sealingly engaged to the base 12 is a sealed light-transmitting glass bulb or envelope 18. According to one embodiment, the envelope 18 may be filled with Krypton. According to other embodiments, the envelope 18 may be filled with other gas, such as argon or may include a vacuum. Also disposed within the envelope 18 and connected to the base 12 is an incandescent lamp assembly 20 having one or more filaments that generate light when electric current is applied to a particular lighting filament.

Figure 2:
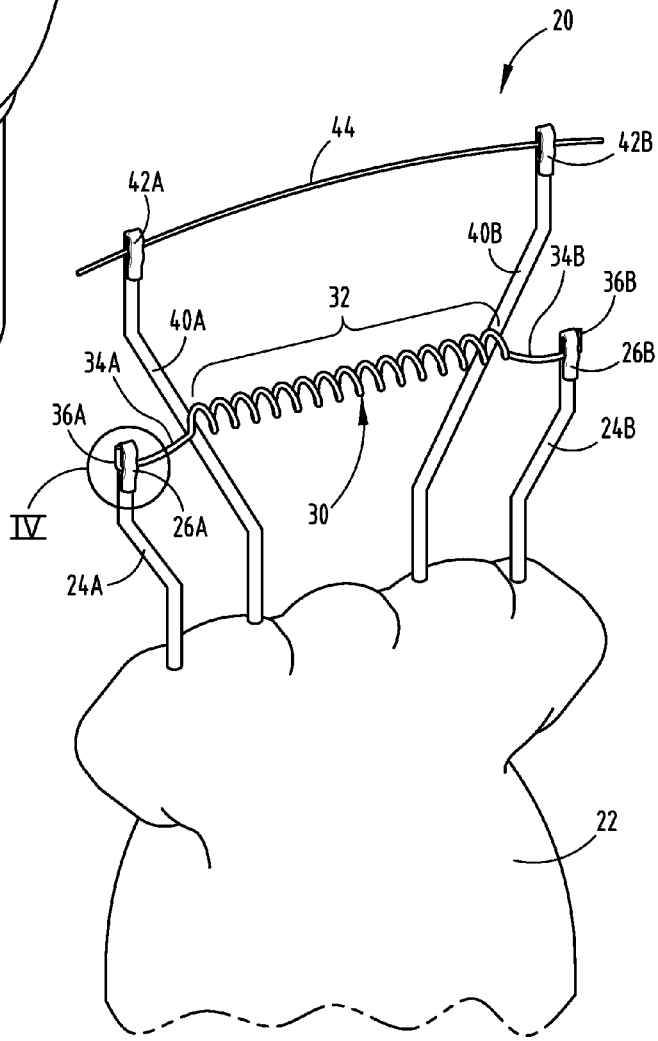
FIG. 2 is an enlarged perspective view of the lamp assembly of FIG. 1 with the base and envelope removed.

The lamp assembly 20 is further illustrated in FIG. 2 having a first or major filament 32 and a second or minor filament 44. The major filament 30 is shown connected at opposite ends to major filament attach lead wires 24A and 24B which, in turn, are electrically coupled to electrical connectors 14 to supply electrical current across the major filament 30 when light output is desired. The minor filament 44 is attached at opposite ends to minor filament attach lead wires 40A and 40B which likewise receive electrical power via electrical connectors 14. In the embodiment shown, the major filament 30 has a centered coil portion 32 formed in the shape of a helix which is generally centered between the terminal end portions of the filament 30. The major filament 30 further includes generally straight portions 34A and 34B extending from opposite sides of the centered coil 32 and attached respectively to the major filament attach lead wires 24A and 24B. Portions 34A and 34B are attached to the major filament attach lead wires 24A and 24B by folding over a portion 26A and 26B of lead wires 24A and 24B, respectively, onto portions 34A and 34B and crimped portions 34A and 34B in place. The crimped portions 34A and 34B each may be formed by forcibly folding an end portion of the lead wires about 180° onto itself to thereby hold the major filament 30 in place. Vibration of the major filament 30 especially when oriented to extend vertically such that its longitudinal axis is generally aligned with the gravitational force vector, may weaken one or more of the crimped attachments and allow movement of the major filament 30. The major filament 30 further has outermost bent portions 36A and 36B which are bent just outside of the crimped attachment to maintain the centered coil 30 in position and prevent migration of the centered coil 32 relative to the attach lead wires 24A and 24B. As a result, migration of the centered coil 32 is prevented due to the bent portions 36A and 36B.

Figure 3:
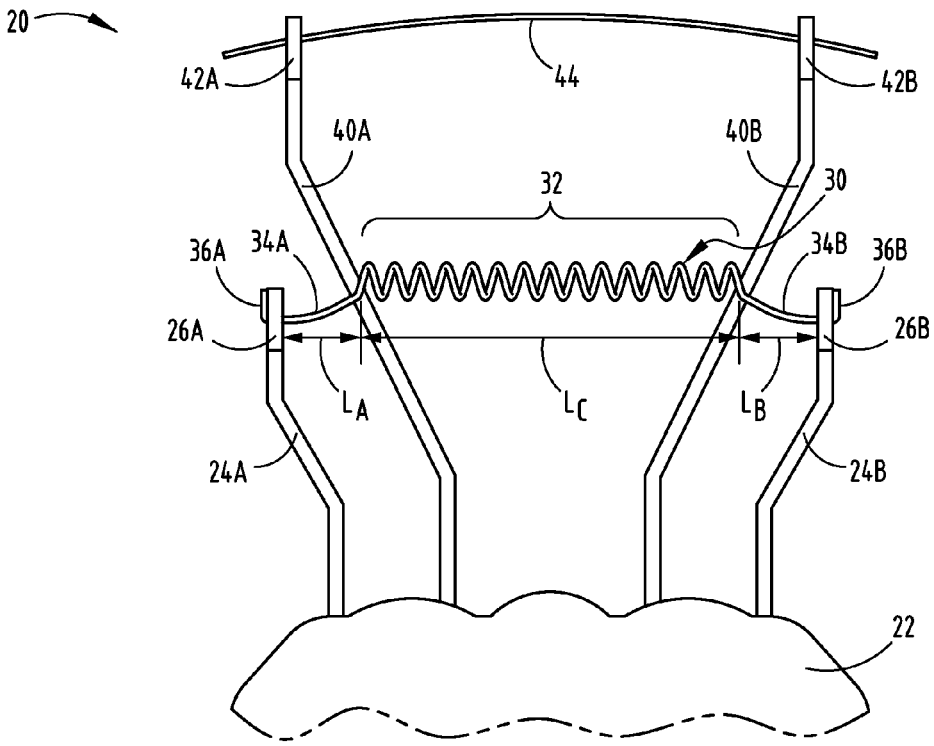
FIG. 3 is an enlarged front view of the lamp assembly of FIG. 1.

Referring to FIG. 3, the major filament 30 is shown having coil portion 32 extending over a length $L_C$ and generally centered between attach lead wires 24A and 24B. Generally elongate straight portions 34A and 34B extend between bent portions 36A and 36B, respectively, and opposite sides of the coil portion 32. Portion 34A has a length $L_A$ that is substantially equal to length $L_B$ of portion 34B when the coil portion 32 is substantially centered between the attach lead wires 24A and 24B. The filament 32 may be made of tungsten which generates light illumination when electrical current is applied across the filament. The supply of electrical current to a given filament may be controlled by switching circuitry in response to a control signal. The coil portion 32 provides enhanced light radiation for a given length.

Figure 4:
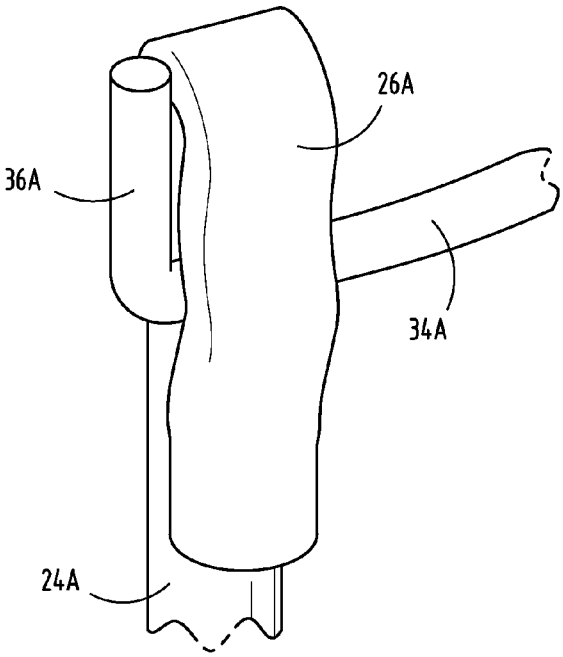
FIG. 4 is an enlarged view of section IV of FIG. 2 further illustrating one bent end portion of the filament and crimped connection to an attach lead wire.
Figure 5:
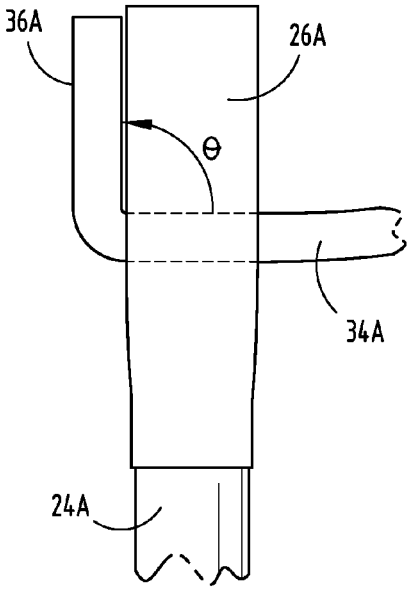
FIG. 5 is a front view of a portion of the filament with the bent portion of the filament and the crimped connection to the attach lead wire.

Referring to FIGS. 4 and 5, the bent portion 36A of major filament 30 in relation to the crimped portion 26A of attach lead wire 24A is illustrated at one end of the major filament 30. It should be appreciated that the opposite end of the major filament 30 is crimped by crimped portion 26B of the attach lead wire 24B just inside bent portion 36B in a manner similar to that shown in FIGS. 4 and 5. The attach lead wires 24A and 24B may be made of an electrically conductive and crimpable material, such a nickel-iron (NiFe). The crimped portion 26A is folded over about 180° under pressure onto portion 34A of filament 30 to form a crimped attachment to hold the filament 30 in place and provide electrical conduction between the attach lead wire 34A and major filament 30.

The bent portion 36A at the terminal end of major filament 30 is shown bent relative to generally straight portion 34A at an angle θ of about 90°, according to one embodiment. The bent portion 36A at the terminal end of the major filament 30 is bent just outside of the attach lead wire 24A such that the lead wire crimped attachment is between the bent portion 36A and the coil portion 32. Similarly, the opposite end having bent portion 36B is likewise formed at angle θ on the outer side of the lead wire crimped attachment. The bent portions 36A and 36B are bent at an angle θ of at least 10°, according to one embodiment. According to a further embodiment, the bent portions 36A and 36B are bent at angle θ in the range of 45° to 120°. The angle θ of the bent portions 36A and 36B is sufficient to hold the major filament 30 in place so as to substantially center the coil portion 32 when the crimped portions 26A and 26B are subject to vibration in conditions that may not otherwise hold the filament 30 centered in place. It should be appreciated that the bent portions 34A and 34B are generally provided at the terminal ends of the filament 30 and the end portion is defined as that portion at or near the end which extends outside of the crimped portions 26A and 26B of attach lead members 24A and 24B.

The dual-filament incandescent lamp 10 shown and described herein may be implemented in a 3157K dual-filament bulb of the type used in brake and tail lamp assemblies on motor vehicles. According to one example, the minor filament 44 may operate at seven (7) watts and provide the tail lamp lighting function such as a turn signal when energized, whereas the major filament 30 may operate at twenty-seven (27) watts and provide the brake lamp function when energized. While the major filament 30 is shown having a coil portion 32 and bent portions 36A and 36B provided to center the coil portion 32, it should be appreciated that the minor filament 44 may likewise include bent portions at the ends of filament 44. Minor filament 44 may further include a coil portion similar to the coil portion 32 of major filament 30. It should further be appreciated that a single filament having a bent portion at each end may be employed in the incandescent lamp 10, and that more than two filaments may be employed according to further embodiments.

Accordingly, the incandescent lamp 10 advantageously employs bent portions at or near the ends of a filament so as to substantially center the filament. The bent portions substantially center the coil portion 32 of the filament 30 for a filament that is crimped to the attached lead wires in a manner that maintains the coil portion substantially centered despite vibrations which may overcome the holding forces of the crimp attachments, particularly when the filament is vertically oriented to align with the gravitational vector.

It is to be understood that variations and modifications can be made on the aforementioned structure without departing from the concepts of the present invention, and further it is to be understood that such concepts are intended to be covered by the following claims unless these claims by their language expressly state otherwise.

What is claimed is:

1. An incandescent lamp comprising:

a first lead wire;

a second lead wire; and a filament crimped to the first and second lead wires and comprising a first end having a first bent portion and a second end having a second bent portion for preventing movement of the filament relative to the first and second lead wires.

2. The lamp of claim 1, wherein each of the first and second bent portions is bent at an angle of at least 10°.

3. The lamp of claim 2, wherein each of the first and second bent portions is bent at an angle in the range of 45° to 120°.

4. The lamp of claim 3, wherein each of the first and second bent portions is bent at an angle of about 90°.

5. The lamp of claim 1, wherein the filament comprises a coil portion between the first and second ends and disposed between the first and second lead wires, wherein the first and second bent portions prevent movement of the coil portion relative to the first and second lead wires.

6. The lamp of claim 1, wherein the lamp is employed on an automotive vehicle.

7. The lamp of claim 6, wherein the lamp is employed as a brake lamp on an automotive vehicle.

8. The lamp of claim 6, wherein the lamp is employed as a turn signal.

9. The lamp of claim 1, wherein the first and second lead wires are crimped over portions of the filament near the first and second ends.

10. The lamp of claim 1 further comprising a base supporting the first and second lead wires and filament and an envelope enclosing the first and second lead wires and the filament.

11. An incandescent lamp comprising:

a first lead wire;

a second lead wire;

a filament comprising first and second end portions crimped to the respective first and second lead wires and a coil portion therebetween, wherein the first end has a first bent portion and the second end has a second bent portion to prevent migration of the coil portion relative to the first and second lead wires.

12. The lamp of claim 11, wherein each of the first and second bent portions is bent at an angle of at least 10°.

13. The lamp of claim 12, wherein each of the first and second bent portions is bent at an angle in the range of 45° to 120°.

14. The lamp of claim 13, wherein each of the first and second bent portions is bent at an angle of about 90°.

15. The lamp of claim 11, wherein the lamp is employed on an automotive vehicle.

16. The lamp of claim 15, wherein the lamp is employed as a brake lamp on an automotive vehicle.

17. The lamp of claim 15, wherein the lamp is employed as a turn signal.

18. The lamp of claim 11, wherein the first and second lead wires are crimped over portions of the filament near the first and second ends.

19. The lamp of claim 11 further comprising a base supporting the first and second lead wires and filament and an envelope enclosing the first and second lead wires and the filament.

* * * * *